US008561836B2

(12) United States Patent
Cook

(10) Patent No.: US 8,561,836 B2
(45) Date of Patent: Oct. 22, 2013

(54) CRATE WITH COLLAPSIBLE WALL

(75) Inventor: Alan J. Cook, Liverpool (GB)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 13/204,769

(22) Filed: Aug. 8, 2011

(65) Prior Publication Data

US 2012/0037647 A1 Feb. 16, 2012

Related U.S. Application Data

(60) Provisional application No. 61/373,139, filed on Aug. 12, 2010.

(51) Int. Cl.
*B65D 6/40* (2006.01)

(52) U.S. Cl.
USPC ..... 220/812; 220/601; 220/4.28; 220/345.1

(58) Field of Classification Search
USPC ..... 220/6, 7, 4.31, 811, 812, 676, 601, 220/4.28–4.34, 345.1; 108/56.1, 56.3; 248/346.3; 119/472–474, 498, 501, 119/524; 206/600, 386; 49/152, 157, 226
See application file for complete search history.

(56) References Cited

U.S. PATENT DOCUMENTS

| | | | | |
|---|---|---|---|---|
| 3,941,271 | A * | 3/1976 | Zarges et al. | 220/6 |
| 4,043,476 | A * | 8/1977 | Joseph | 220/485 |
| 4,163,495 | A * | 8/1979 | Drader | 206/506 |
| 5,924,572 | A * | 7/1999 | Cope | 206/518 |
| 6,170,689 | B1 * | 1/2001 | Flesher et al. | 220/7 |
| 7,264,122 | B2 * | 9/2007 | Koefelda et al. | 206/600 |
| 7,658,427 | B2 * | 2/2010 | Patton, Jr. | 296/50 |
| 2007/0187276 | A1 * | 8/2007 | Stahl | 206/505 |
| 2008/0169285 | A1 * | 7/2008 | Marazita et al. | 220/7 |
| 2009/0134157 | A1 * | 5/2009 | Meers | 220/7 |
| 2012/0111859 | A1 * | 5/2012 | Pils et al. | 220/4.28 |

FOREIGN PATENT DOCUMENTS

| | | | |
|---|---|---|---|
| EP | 2 030 903 | A1 | 3/2009 |
| EP | 1 935 792 | B1 | 11/2010 |
| GB | 2 449 502 | A | 11/2008 |
| GB | 2 426 237 | B | 12/2008 |
| WO | 2011/006654 | A1 | 1/2011 |

OTHER PUBLICATIONS

United Kingdom Search Report for UK Application No. GB1113836.9, Nov. 29, 2011.

* cited by examiner

*Primary Examiner* — J. Gregory Pickett
*Assistant Examiner* — Mollie Llewellyn
(74) *Attorney, Agent, or Firm* — Carlson, Gaskey & Olds

(57) ABSTRACT

A crate or container, such as for transporting egg cartons or other items includes a base, opposed side walls and a rear wall extending upward from the base. A front wall opposite the rear wall includes an upper section and a lower section having a pair of rails extending upward therefrom. The upper section is selectably slidable on the rails between an upper, closed position and a lower, retracted, open position. In the retracted position, access to the interior of the crate is provided through the front of the crate.

24 Claims, 13 Drawing Sheets

CRATE WITH COLLAPSIBLE WALL

This application claims priority to U.S. Provisional Application Ser. No. 61/373,139, filed Aug. 12, 2010.

BACKGROUND OF THE INVENTION

The present invention relates generally to containers and more particularly to a crate that is particularly useful for transporting egg cartons or other items to a store.

Currently, egg cartons are shipped to stores in metal crates. The crates must be unloaded onto shelves for the customers to select and purchase. This requires labor for handling the egg cartons in the store. The metal crates are expensive and are damaged easily. They are also subject to rust and are not recyclable. They are also not easily repairable.

SUMMARY OF THE INVENTION

The present invention provides a crate or container, such as for transporting egg cartons or other items. The crate includes a base, opposed side walls and a rear wall extending upward from the base. A front wall opposite the rear wall includes an upper section and a lower section having rails extending upwardly therefrom. The upper section is selectably slidable on the rails between an upper, closed position and a lower, retracted, open position. In the retracted position, access to the interior of the crate is provided through the front of the crate.

In use, egg cartons (or other items) would be shipped to a store in the crate with the upper section of the front wall closed. At the store, the upper section of the front wall would be retracted to provide access to the egg cartons in the interior of the crate by customers or by store workers. The empty crate can then be returned to be reused in shipping additional egg cartons.

These and other features of the present invention can be best understood from the following specification and drawings, the following of which is a brief description.

DETAILED DESCRIPTION OF THE PREFERRED EMBODIMENT

Figure 1:
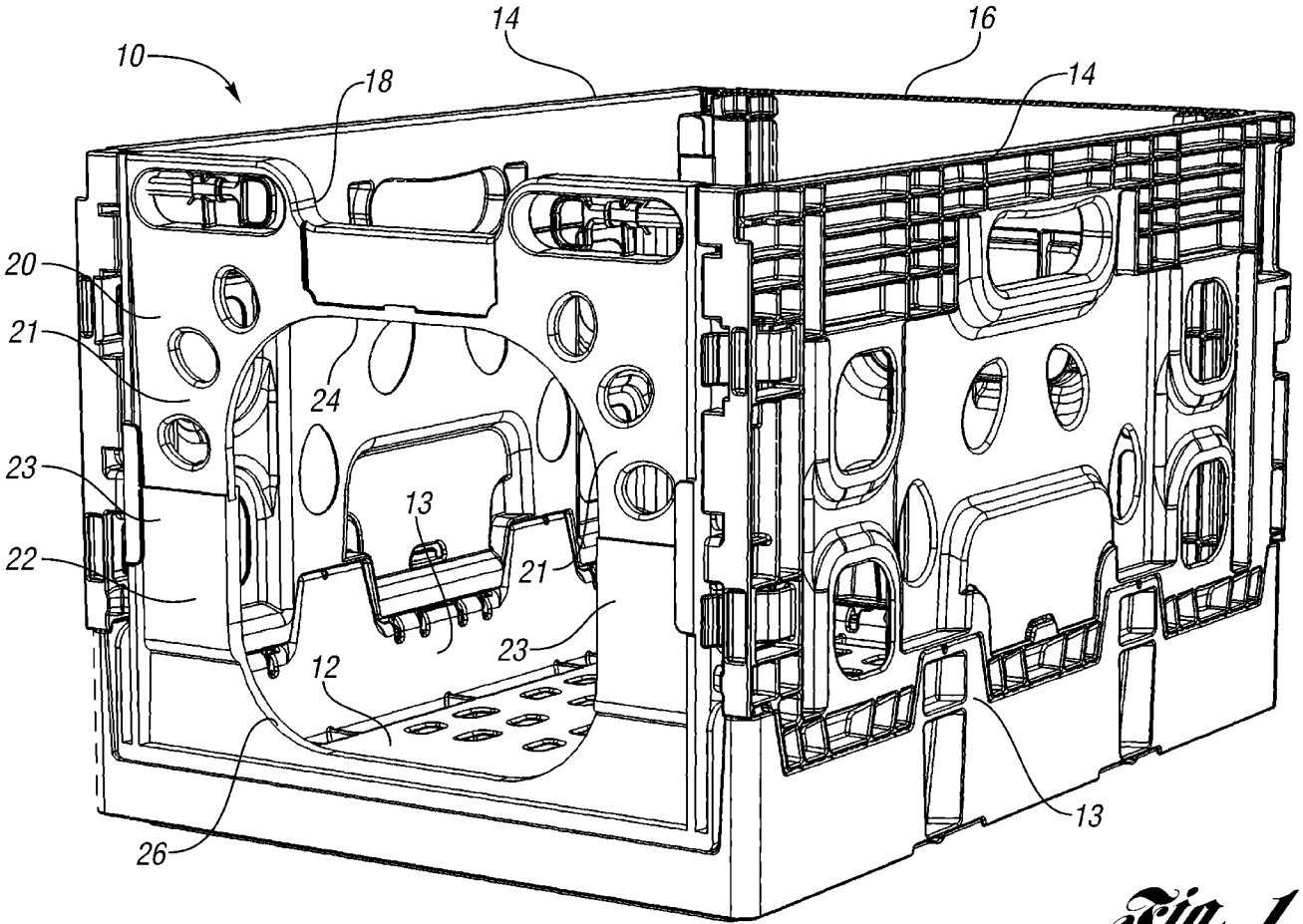
FIG. 1 is a front perspective view of a crate according to a first embodiment of the present invention.

A crate 10, such as for transporting egg cartons or other items, according to one embodiment of the present invention is shown in FIG. 1. The crate 10 includes a base 12 having integrally molded upstanding portions 13 to which are hingably connected side walls 14. A rear wall 16 is also hingably connected to the base 12 and latched to the side walls 14.

The front wall 18 includes an upper section 20 having a pair of downwardly extending arms 21 and a lower section 22 having a pair of upwardly extending arms 23. The arms 21 of the upper section 20 are supported on and interlocked with arms 23 of the lower section 22. Between the arms 21 of the upper section 20 is an upper opening 24, which is also defined by a contoured lower edge of the upper section 20. Between the arms 23 of the lower section 22 is a lower opening 26, which is also defined by a contoured upper edge of the lower section 22.

Figure 2:
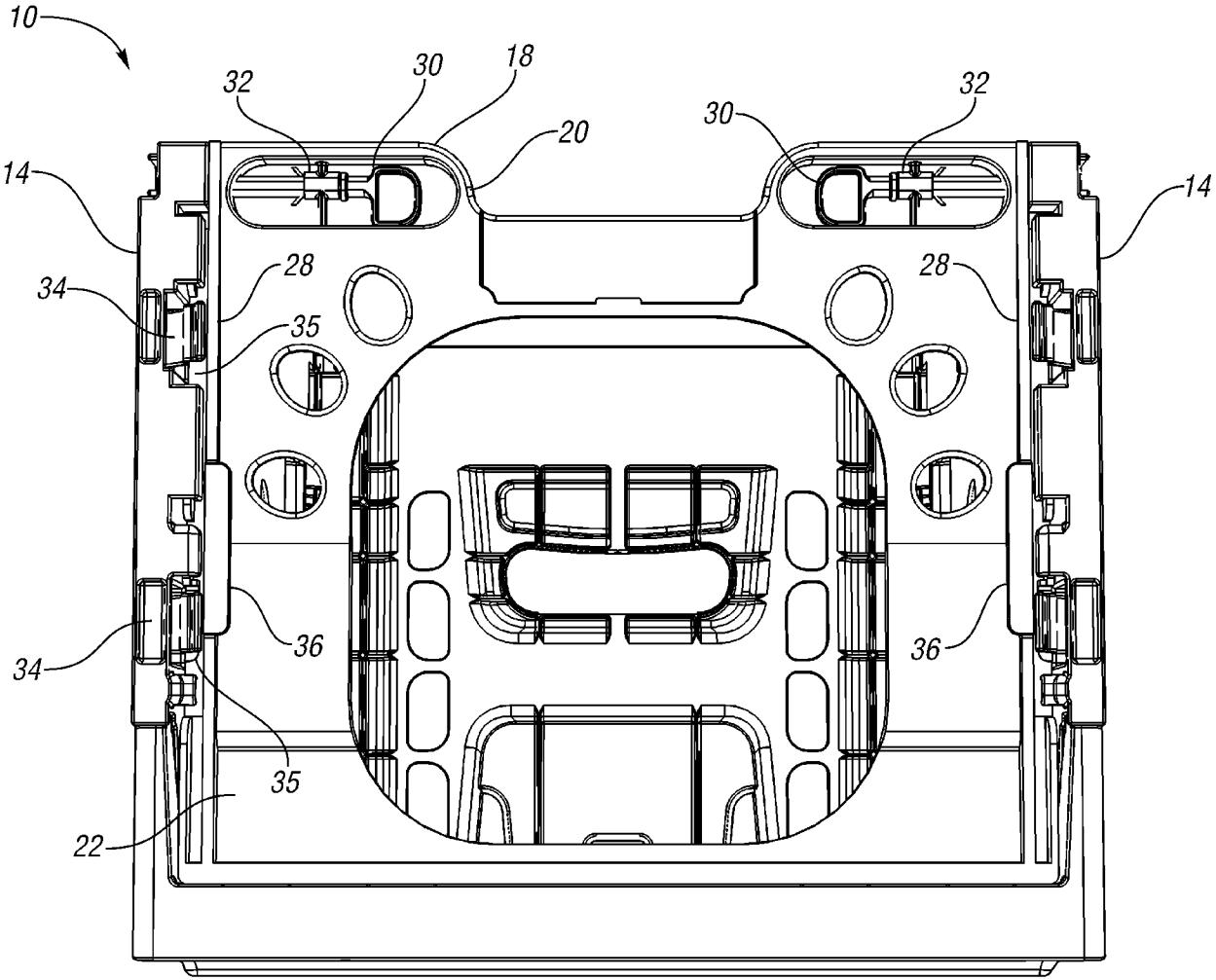
FIG. 2 is an enlarged view of the front of the crate of FIG. 1.

FIG. 2 is an enlarged perspective view of the front of the crate 10. The upper section 20 is slidably received between rails 28 extending upwardly from opposite sides of the lower section 22. A pair of latches 30 are slidably mounted in sleeves 32 in the upper section 20 and are spring-biased outward toward a latched position interlocked with the rails 28. The side walls 14 each include latches 34 adjacent latch plates 35 on the rails 28 and the lower section 22. The side walls 14 each include a pair of flanges 36 protruding over the exterior of the rails 28, upper section 20 and lower section 22.

Figure 3:
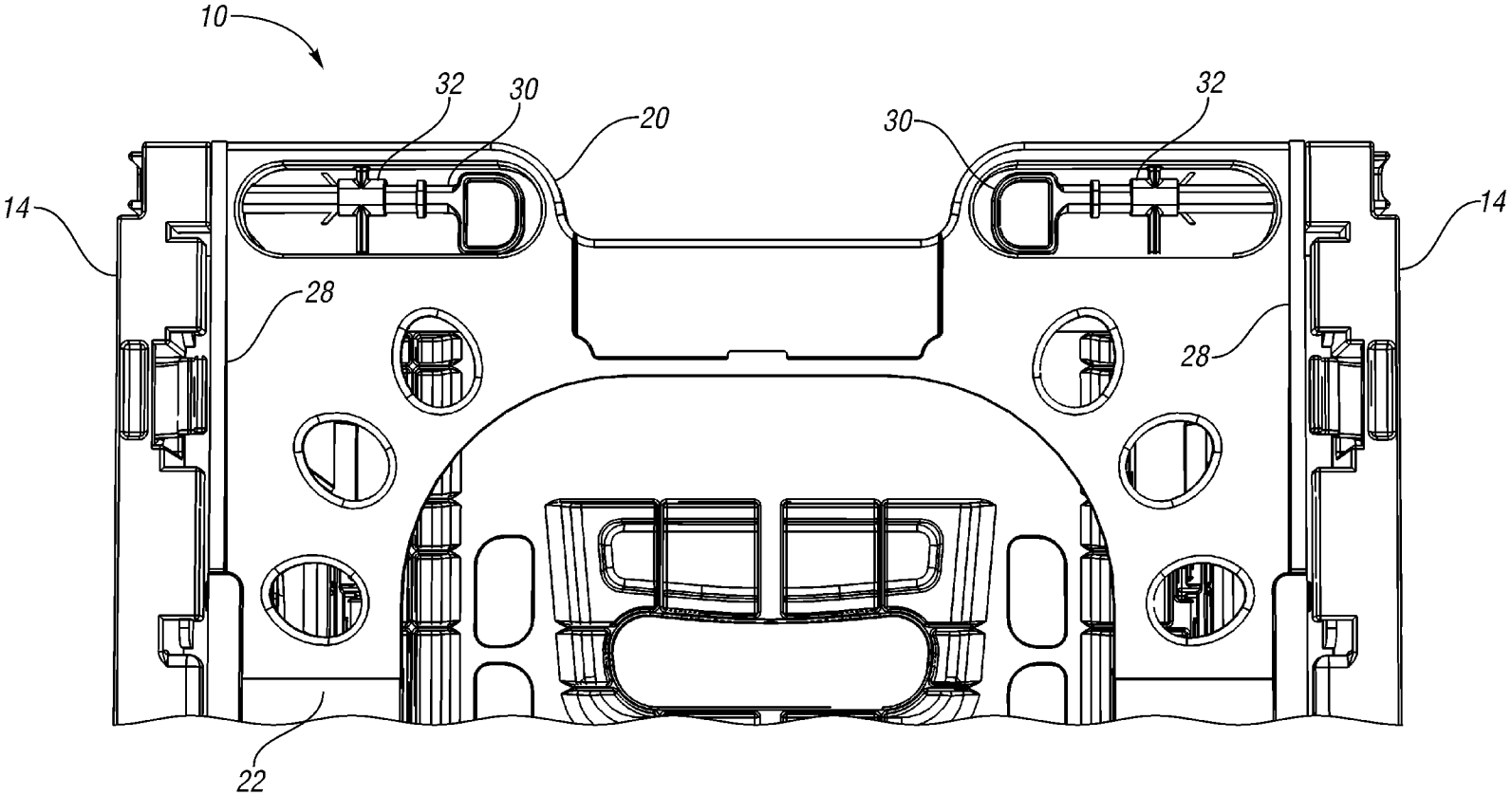
FIG. 3 shows the upper portion of the front of the crate of FIG. 1 with the latches in a released position.

FIG. 3 shows the latches 30 moved toward one another (against the spring-bias) to the released position, in which the upper section 20 can slide relative to the lower section 22 and relative to the rails 28. In the released position, the latches 30 are not latched to the side walls 14 or the rails 28.

Figure 4:
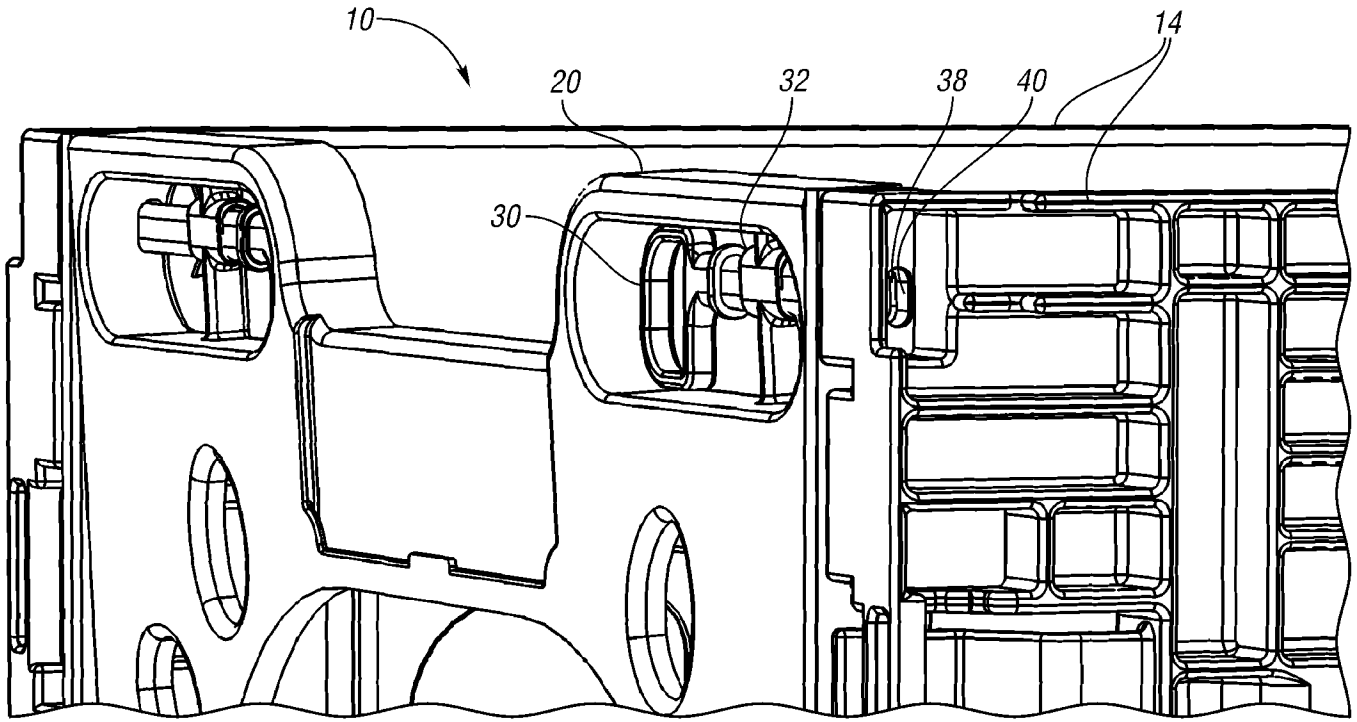
FIG. 4 is a perspective view of the upper portion of FIG. 3.

In FIG. 4, the latches 30 are shown in the released position, but are aligned with upper openings 38 through the rails 28 and upper openings 40 in the side walls 14. In the latched position, the ends of the latches 30 would be received in the upper openings 38 in the rails 28 and the upper openings 40 in the side walls 14, thereby latching the upper sections 20, rails 28 and side walls 14 together.

Figure 5:
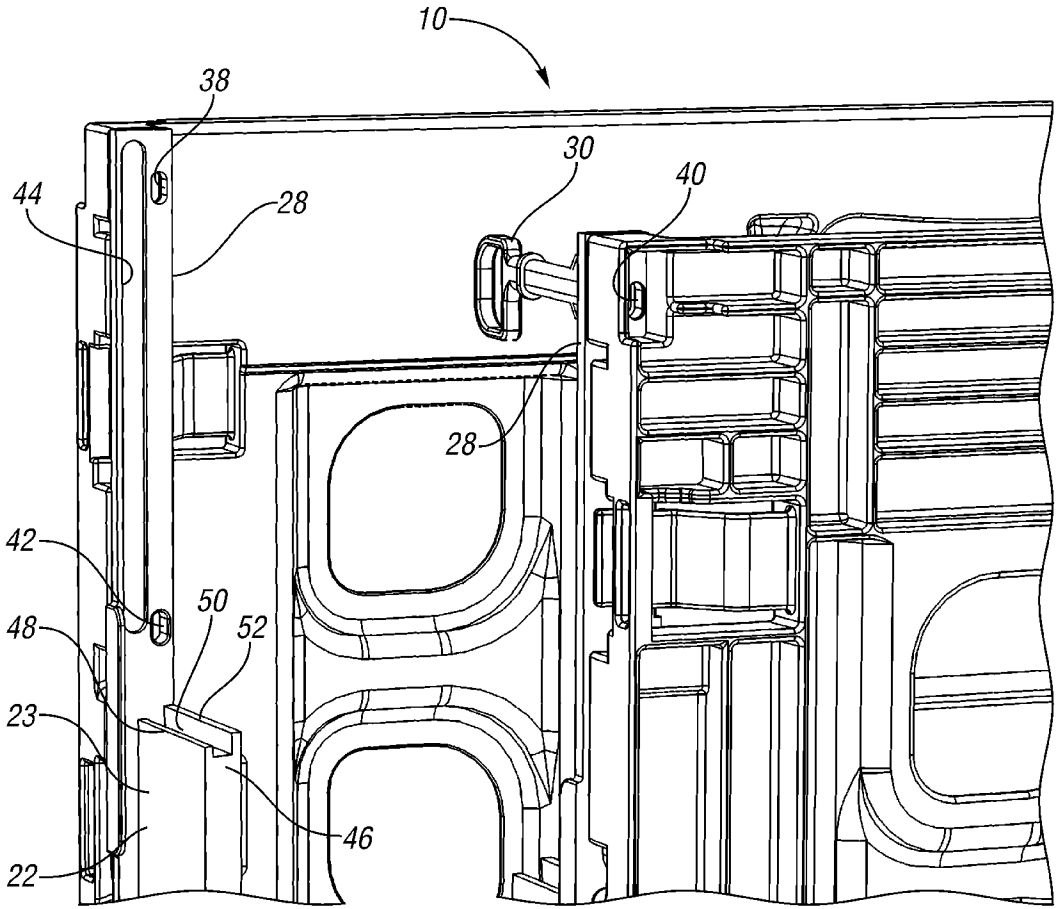
FIG. 5 shows one of the latches of the upper portion of FIG. 4 with the upper section of the wall removed.

FIG. 5 shows the crate 10 with the upper section 20 removed and with one of the latches 30 in place. The rails 28 each include the upper openings 38 and a similar lower opening 42. The rails 28 each further include an elongated vertical slot 44 in which the upper section 20 (FIG. 4) slides. The upper edge 46 of each arm 23 of the lower section 22 includes an outer rib 48 a recess 50 and an inner rib 52 for interlocking with the lower end of the arms 21 (FIG. 1) of the upper section 20.

Figure 6:
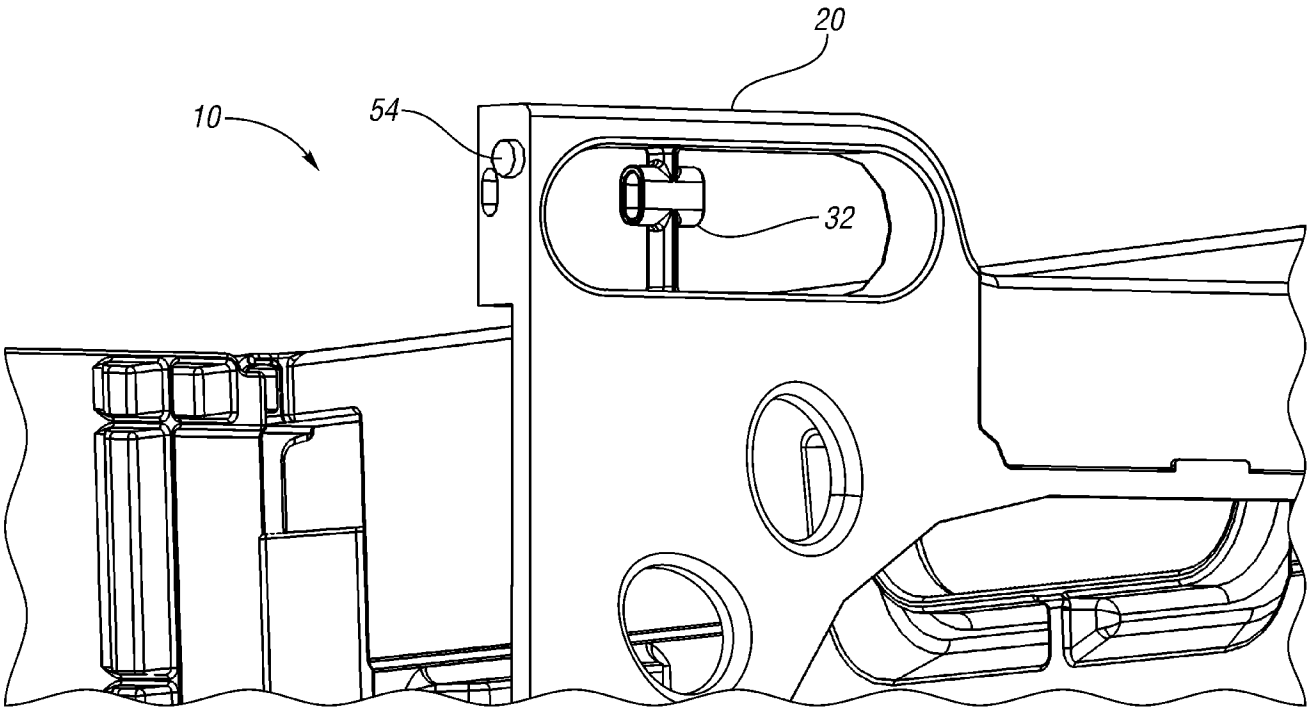
FIG. 6 is a perspective view of one end of the upper section of the wall, with the latch removed.

FIG. 6 shows one end of the upper portion of the upper section 20. A pin 54 protrudes outwardly from each end of the upper section 20. The pin 54 is slidably received in the vertical slot 44 (FIG. 5) of the rail 28.

Figure 7:
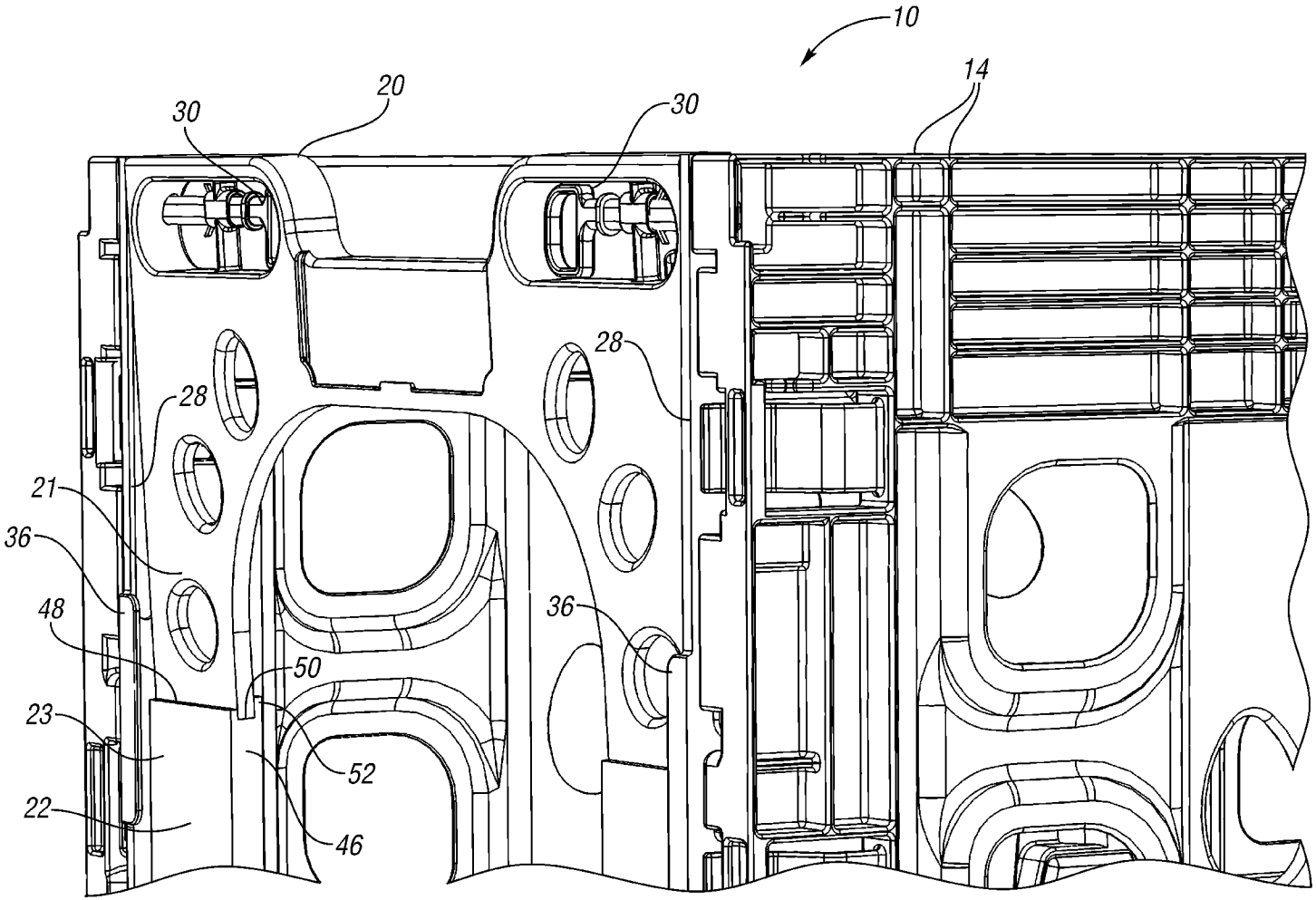
FIG. 7 shows the upper portion of FIG. 3 with the upper section of the wall moved to a first step for sliding the upper section down.
Figure 8:
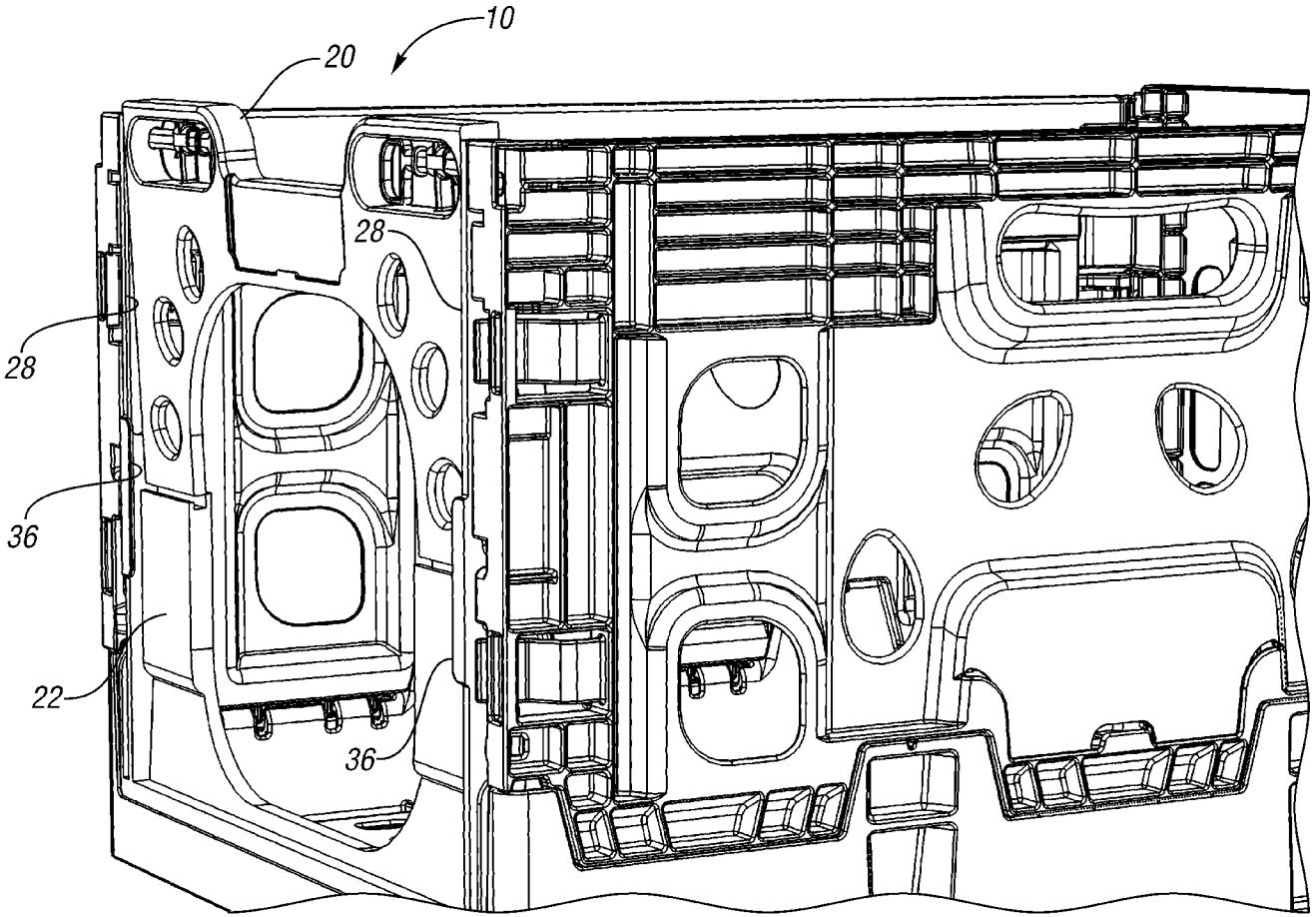
FIG. 8 shows the upper portion of FIG. 7 in a second step for sliding the upper section down.

Referring to FIG. 7, in order to retract the upper section 20, the latches 30 are moved inwardly (against the spring-bias) to release the latches 30 from the rails 28 and side walls 14. The upper section 20 is then slid upwardly slightly higher (in this example, slightly higher than the side walls 14) with the pin 54 sliding in the slot 44 (FIGS. 6 and 5, respectively) until the lower ends of the arms 21 of the upper section 20 are removed from the recesses 50 in the arms 23 of the lower section 22. The lower end of the upper section 20 is then free to pivot outwardly, as shown in FIG. 8, until the lower end of the upper section 20 is clear of the lower section 22. Flanges 36 extending inwardly from the rails 28 outward of the upper section 20 trap the lower end of the upper section 20 slidably between the flanges 36 and the lower section 22.

Figure 9:
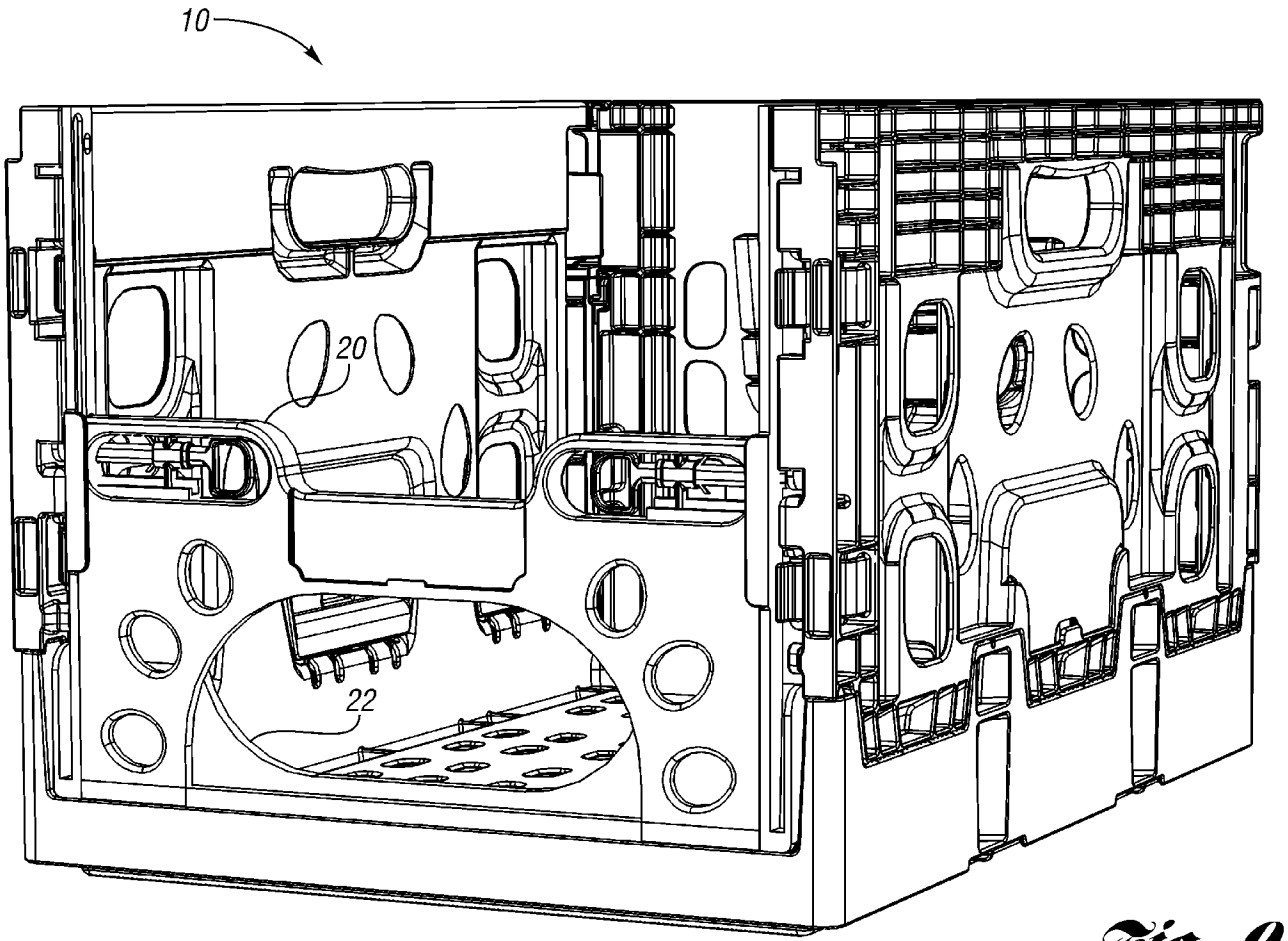
FIG. 9 shows the crate of FIG. 1 with the upper section of the front wall in the retracted position.

The upper section 20 can then be slid down to the retracted position shown in FIG. 9, with the upper section 20 outward of the lower section 22. The latches 30 are then biased into the lower openings 42 in the rails 28 (FIG. 5) to hold the upper section 20 in position. This provides access to the interior of the crate 10.

Figure 10:
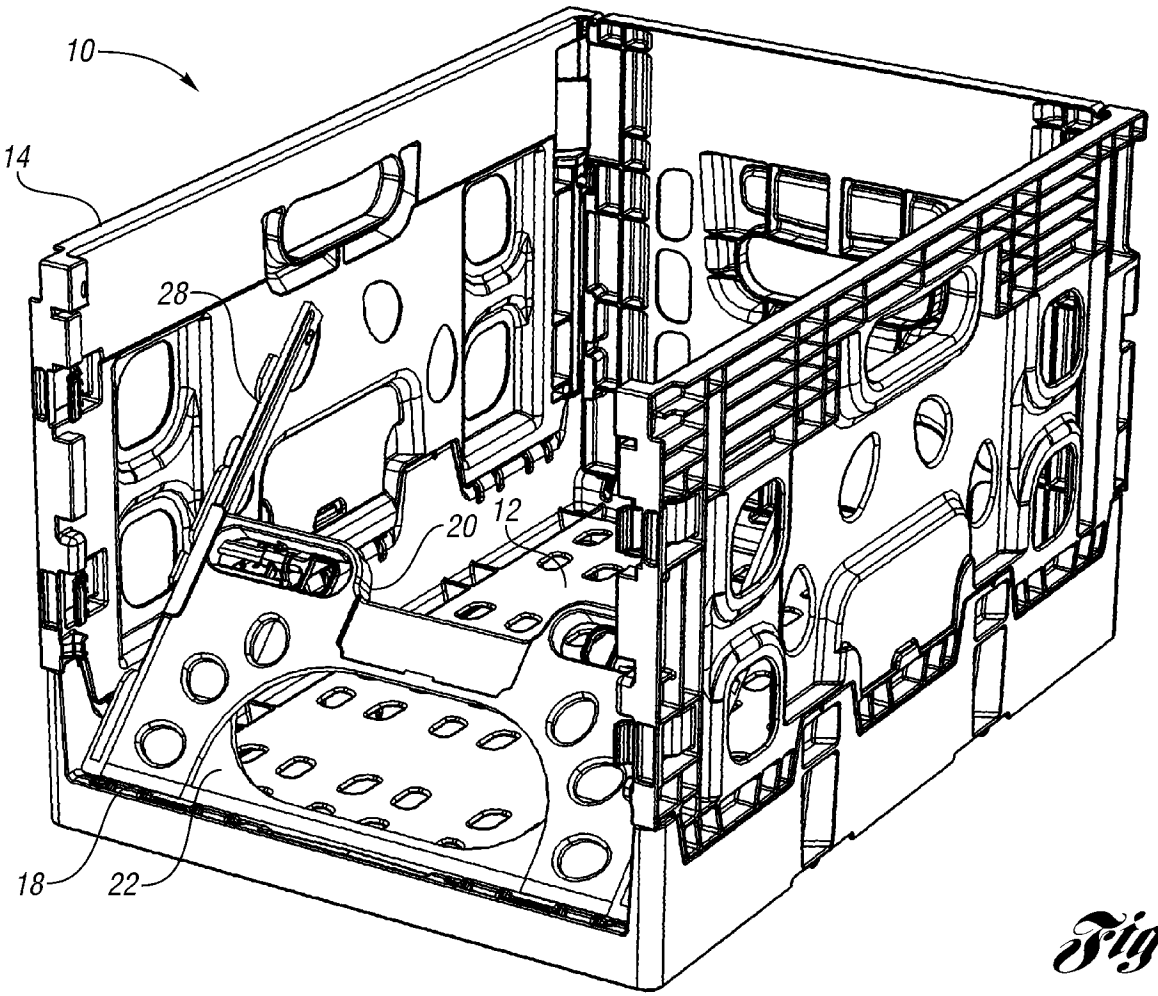
FIG. 10 shows the crate of FIG. 9 with the front wall pivoting toward a collapsed position.

As shown in FIG. 10, the front wall 18 can be pivoted onto the base 12 to a collapsed position (with the upper section 20 in the retracted position, as shown, or with the upper section 20 in the closed position). The other walls can be collapsed onto the base 12 as well, in a known manner.

In use, egg cartons (or other items) would be shipped to a store in the crate 10 with the front wall 18 closed (FIG. 1). The latches 34 are secured to the latch plates 35 on the lower section 22 and rails 28 to maintain the front wall 18 closed. At the store, the upper section 20 of the front wall 18 would be retracted (FIG. 9) to provide access to the egg cartons in the interior of the crate 10 by customers or by store workers, while the latches 34 and latch plates 35 still maintain the front wall 18 in the closed position. When empty, the latches 34 are released and the front wall 18 (upper section 20 retracted or not), the side walls 14 and rear wall 16 are collapsed onto the base 12 so that the crates 10 occupy less volume and can be efficiently returned to be reused in shipping additional egg cartons (or other items).

Figure 11:
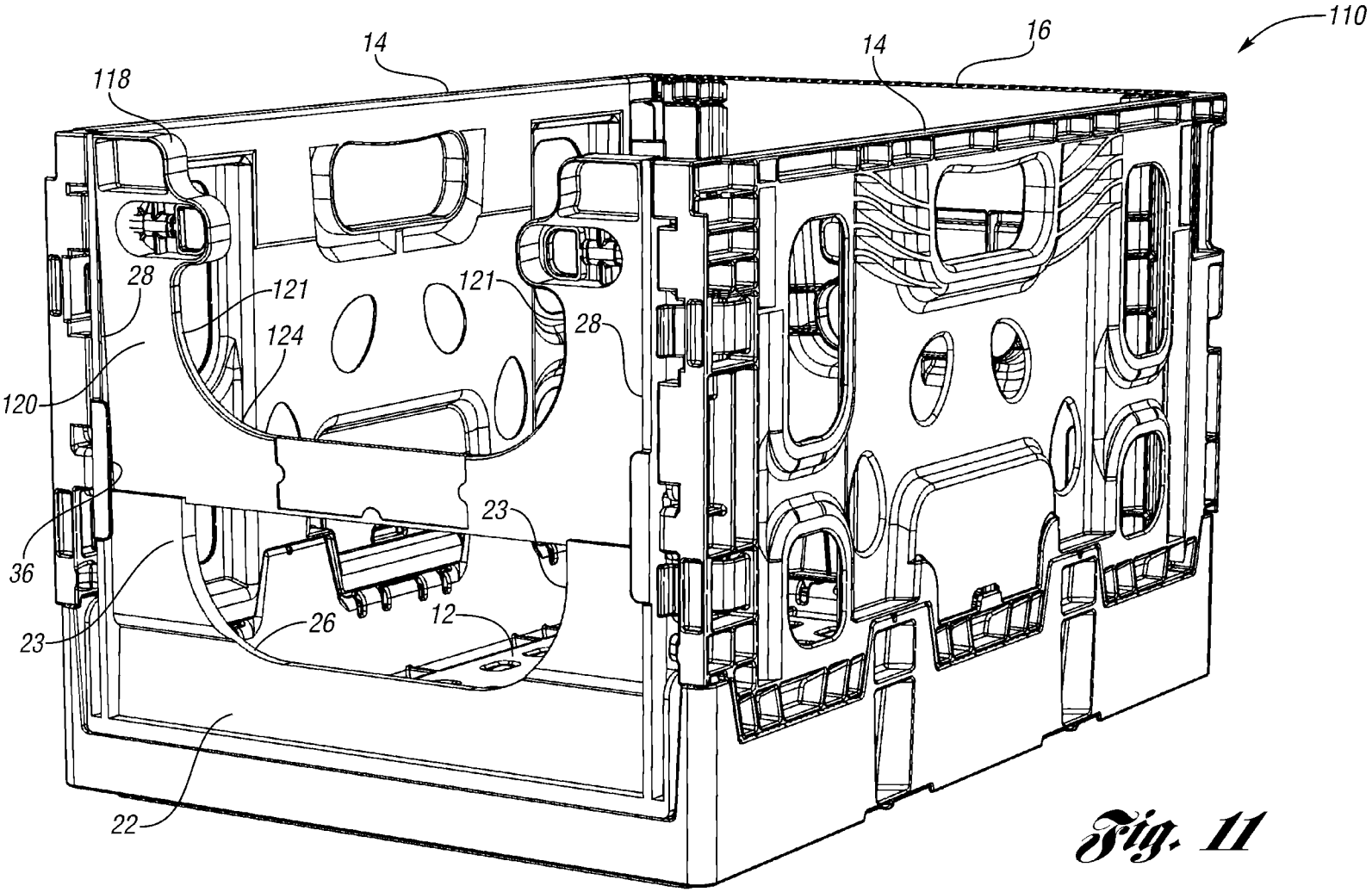
FIG. 11 is a perspective view of a crate according to a second embodiment, with an alternative upper section of the front wall.
Figure 12:
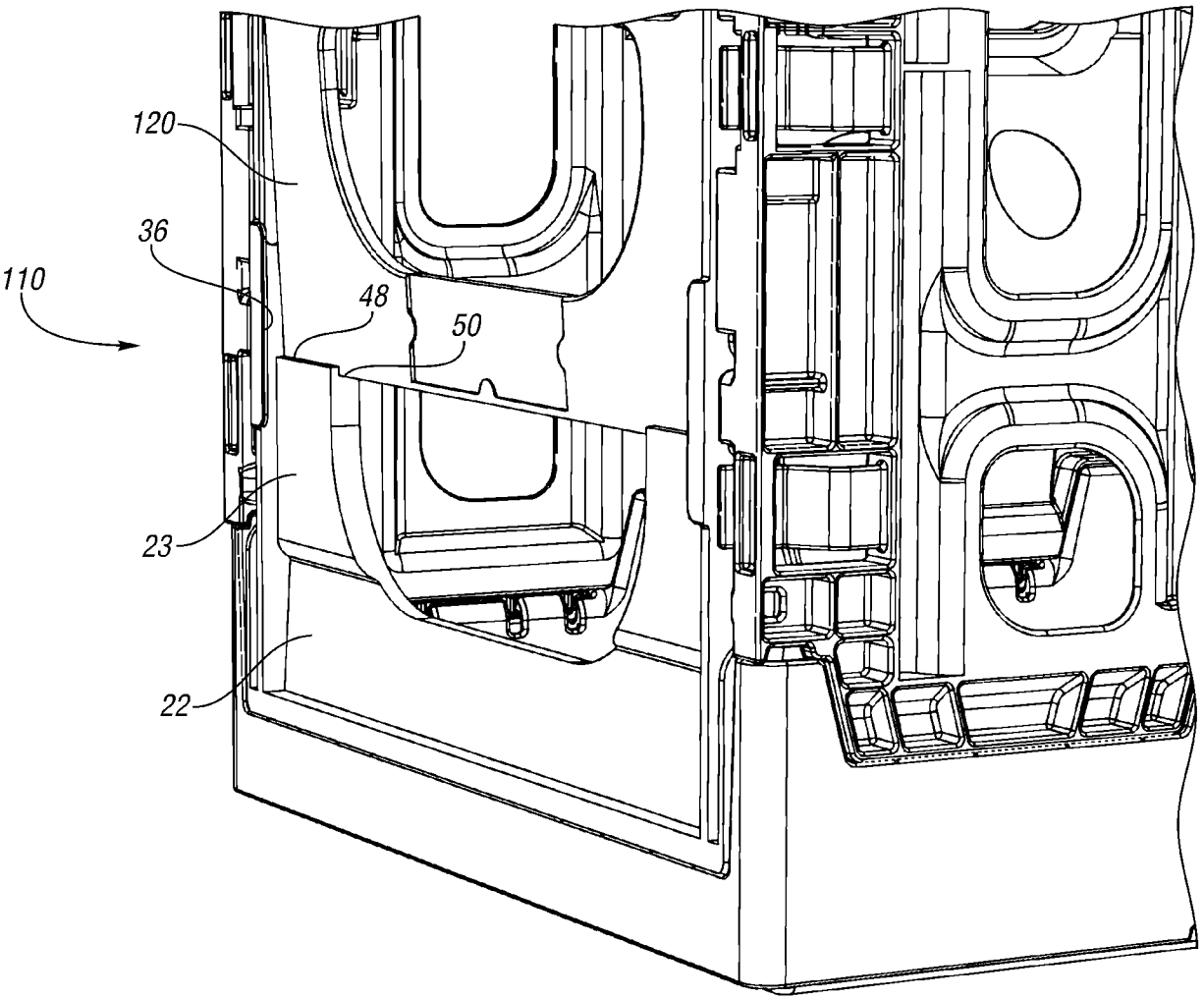
FIG. 12 is an enlarged side perspective view of the front wall of the crate of FIG. 11.

FIG. 11 is a perspective view of a crate 110 according to a second embodiment, with an alternative upper section 120 of the front wall 118. The base 12, side walls 14, rear wall 16, lower section 22 and rails 28 are the same as in the first embodiment. The upper section 120 includes a pair of arms 121 extending upwardly defining an opening 124 therebetween. The lower end of the upper section 120 is supported on and interlocked with the outer rib 48 and recess 50 at the upper end of the lower section 22, as shown more clearly in FIG. 12.

Figure 13:
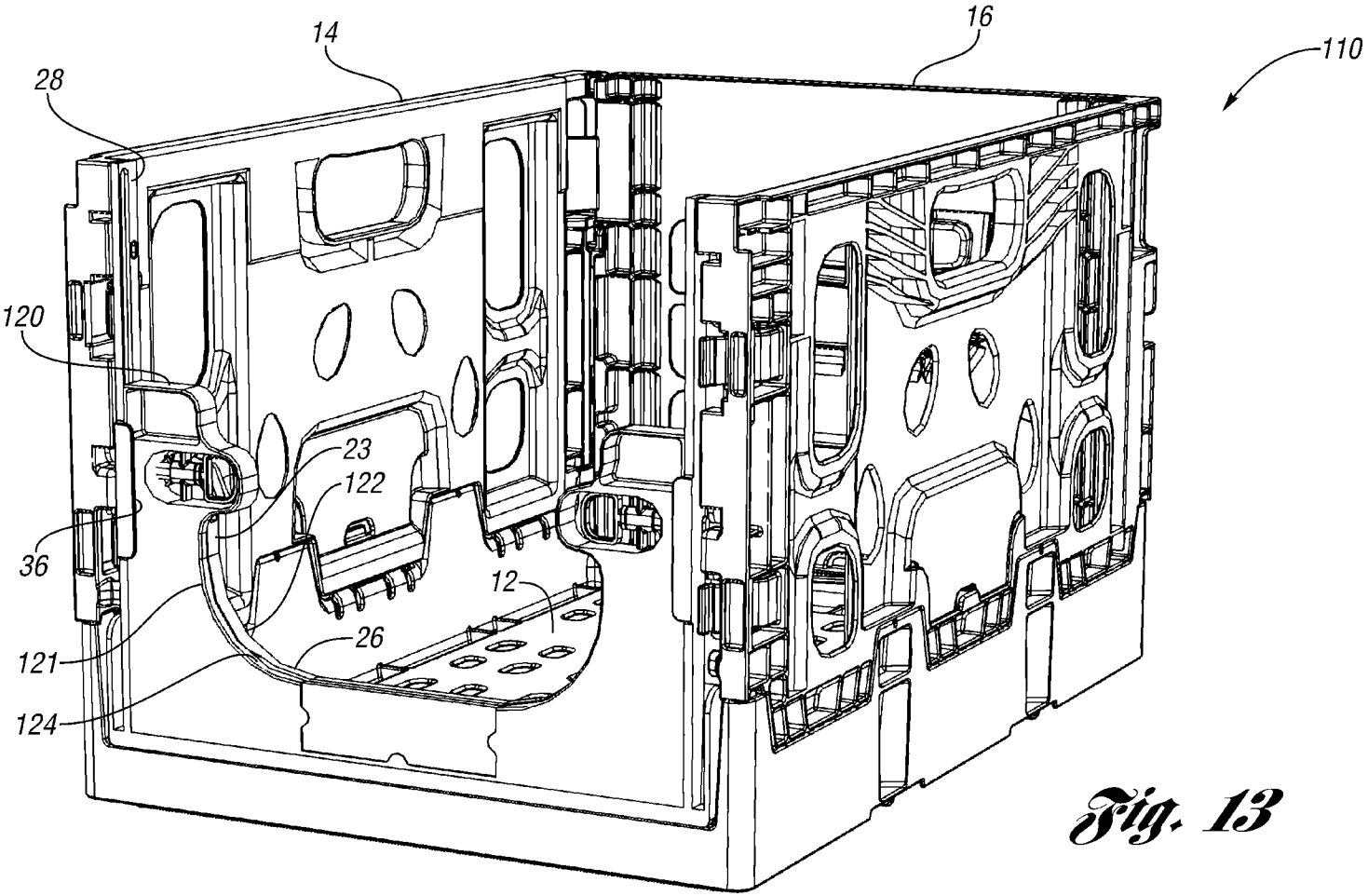
FIG. 13 shows the crate of FIG. 11 with the upper section of the front wall in the retracted position.

FIG. 13 shows the crate of FIG. 11 with the upper section 120 of the front wall in the retracted position (the upper section 120 is moved to the retracted position the same way the upper section 20 of the first embodiment is moved to the retracted position). In the retracted position, the opening 124 of the upper section 120 aligns with the opening 126 of the lower section 122. The upper section 120 and lower section 122 are both U-shaped and oriented the same direction, such that when the upper section 120 is slid down, the openings in the U-shaped sections 120, 122 align, providing increased access to the crate 110.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. Alphanumeric identifiers on method steps are for convenient reference in dependent claims and do not signify a required sequence of performance unless otherwise indicated in the claims.

What is claimed is:

1. A container comprising:

a base;

a pair of opposed side walls; and a front wall at a front of the container, the front wall including a lower section and a pair of rails extending upwardly from the lower section, the front wall further including an upper section slidably secured to the pair of rails, the upper section slidable between an upper position and a retracted position, wherein access to the container through the front of the container is restricted when the upper section is in the upper position and wherein access to the container through the front of the container is permitted when the upper section is in the retracted position, wherein an outer surface of the upper section faces outward of the container in both the upper position and in the retracted position.

2. The container of claim 1 wherein the upper section is pivotably and slidably secured to the pair of rails.

3. The container of claim 1 further including at least one latch for selectively securing at least one of the pair of rails to at least one of the side walls.

4. The container of claim 1 further including a latch for selectively securing the upper section to one of the rails.

5. The container of claim 4 wherein the latch selectively secures the upper section and the one of the rails to one of the side walls.

6. The container of claim 1 wherein the rails each include a flange extending over the upper section.

7. The container of claim 1 wherein a lower portion of the upper section rests on the lower section.

8. The container of claim 7 wherein the lower portion of the upper section interlocks with the lower section.

9. The container of claim 1 wherein the upper section must be lifted and pivoted before being slid downward on the rails to the retracted position.

10. The container of claim 1 wherein the front wall is collapsible onto the base.

11. The container of claim 10 wherein the upper section is slidable on the rails between an upper position and the retracted position below the upper position and wherein the front wall is collapsible onto the base when the upper section is in the upper position and when the upper section is in the retracted position.

12. The container of claim 1 wherein the front wall and the side walls are selectively collapsible onto the base.

13. The container of claim 1 wherein the upper section is slidable to a position in front of the lower section with an interior surface of the upper section abutting an exterior surface of the lower section.

14. The container of claim 1 wherein the upper section includes a pair of spaced apart arms defining an opening therebetween and wherein the lower section includes a pair of spaced apart arms defining an opening therebetween.

15. The container of claim 14 wherein the opening of the upper section and the opening of the lower section both open upwardly.

16. A container comprising:

a base;

a pair of opposed side walls extending upward from the base; and a front wall extending upward from the base, the front wall having a lower section and an upper section, the upper section slidable between an upper position and a retracted position, a lower edge of the upper section supported on the lower section in the upper position, the lower edge of the upper section closer to the base in the retracted position than in the upper position, the upper section positioned in front of the lower section in the retracted position, wherein the lower edge of the upper section must be lifted and pivoted outward before being slid downward toward the retracted position.

17. The container of claim 16 wherein a lower portion of the upper section interlocks with an upper portion of the lower section when the upper section is in the upper position.

18. The container of claim 1 further including at least one latch for selectively securing at least one of the pair of rails to at least one of the side walls, wherein the front wall is collapsible onto the base together with the pair of rails.

19. The container of claim 16 wherein the front wall includes a pair of rails extending upwardly from the lower section, the container further including at least one latch for selectively securing at least one of the pair of rails to at least one of the side walls, wherein the front wall is collapsible onto the base together with the pair of rails.

20. The container of claim 1 wherein the upper section is substantially above the lower section in the upper position and wherein the upper section substantially overlaps the lower section in the retracted position.

21. A container comprising:

a base;

a pair of opposed side walls; and a front wall including a lower section and a pair of rails extending upwardly from the lower section, the front wall further including an upper section slidably secured to the pair of rails, the upper section slidable between an upper position and a retracted position, wherein the upper section restricts access to the container through the pair of rails in the upper position and the upper section permits access to the container through the rails when the upper section is in the retracted position, wherein an outer surface of the upper section faces outward of the container in both the upper position and in the retracted position, wherein the upper section is slidable to the retracted position in front of the lower section with an interior surface of the upper section abutting an exterior surface of the lower section.

22. The container of claim 21 wherein the upper section is substantially above the lower section in the upper position and wherein the upper section substantially overlaps the lower section in the retracted position.

23. The container of claim 1 wherein the upper section is substantially above the lower section in the upper position such that a lower edge of the upper section is proximate an upper edge of the lower section, and wherein the upper section substantially overlaps the lower section in the retracted position such that an upper edge of the upper section is proximate the upper edge of the lower section.

24. The container of claim 1 wherein a lower edge of the upper section is closer to the base in the retracted position than in the upper position.

* * * * *

UNITED STATES PATENT AND TRADEMARK OFFICE

CERTIFICATE OF CORRECTION

PATENT NO. : 8,561,836 B2
APPLICATION NO. : 13/204769
DATED : October 22, 2013
INVENTOR(S) : Alan J. Cook It is certified that error appears in the above-identified patent and that said Letters Patent is hereby corrected as shown below:

IN THE CLAIMS:

In claim 11, column 4, line 32; remove “an” and replace with --the--

Signed and Sealed this
Seventh Day of October, 2014

Michelle K. Lee

Michelle K. Lee
*Deputy Director of the United States Patent and Trademark Office*